United States Patent [19]

Larson

[11] Patent Number: 4,860,467

[45] Date of Patent: Aug. 29, 1989

[54] STRETCHING FRAME WITH ADHESIVE FASTENING OF A FABRIC WORKPIECE

[76] Inventor: James D. Larson, 6323-83rd Ave. SE., Snohomish, Wash. 98290

[21] Appl. No.: 198,180

[22] Filed: May 24, 1988

[51] Int. Cl.[4] ..... D06C 3/08

[52] U.S. Cl. ..... 38/102.4; 38/102.91; 160/378; 160/383; 101/127.1; 101/415.1; 209/403

[58] Field of Search ..... 38/102.91, 102.4, 102.1, 38/102.9, 102.2; 430/160; 160/378, 383; 209/403; 101/415.1, 127.1; 69/19.3

[56] References Cited

U.S. PATENT DOCUMENTS

| | | | |
|---|---|---|---|
| 2,832,171 | 4/1958 | Batey | 38/102.91 |
| 3,416,445 | 12/1968 | Krueger | 101/128.1 |
| 3,477,574 | 11/1969 | Malfroy | 160/378 |
| 3,601,912 | 8/1971 | Dubbs | 38/102.91 |
| 3,886,990 | 6/1975 | Campione | 38/102.91 X |
| 3,924,343 | 12/1975 | Johnson | 38/102.1 |
| 4,519,151 | 5/1985 | Johnson | 38/102.9 |
| 4,620,382 | 11/1986 | Sallis | 38/102.2 |
| 4,751,166 | 6/1988 | Platzer et al. | 430/160 |

*Primary Examiner*—Andrew M. Falik

*Attorney, Agent, or Firm*—Graybeal, Jensen & Puntigam

[57] ABSTRACT

A method of tensioning screening material on a tension frame for use in a silk screen process including the steps of (1) squaring the material, (2) attaching the material to rotatable frame members along a portion of their length by adhesive (3) rotating the frame members until the appropriate tension is reached, and (4) securing the frame members in position. The fabric may be retensioned without removal. The frame includes four rotatable cylindrical elements including a plug at each end which has a plurality of radial bores for rotation by a spanner wrench.

4 Claims, 2 Drawing Sheets

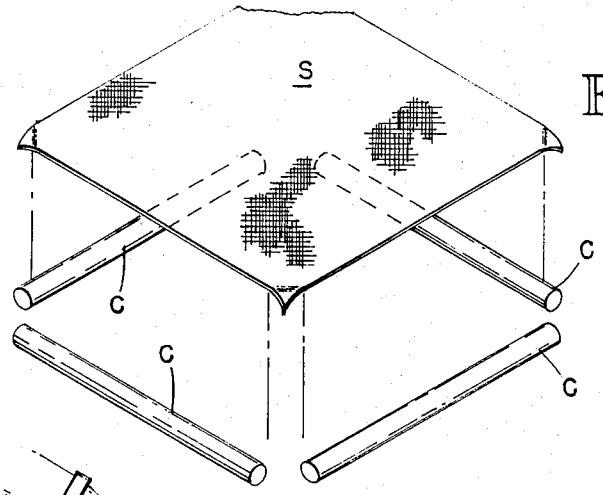
FIG. 3
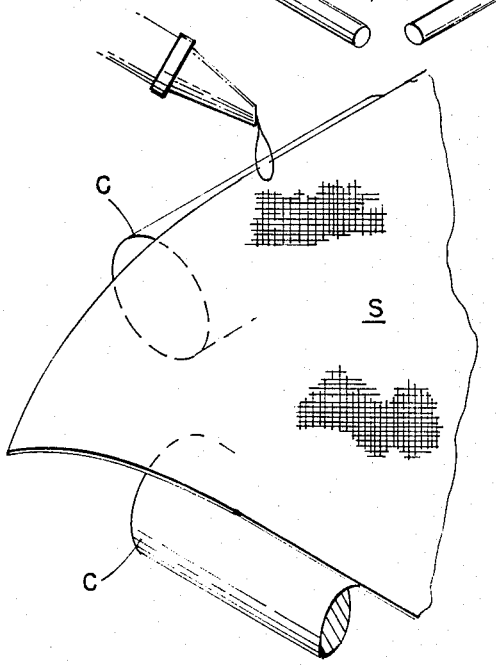
FIG. 4
FIG. 6
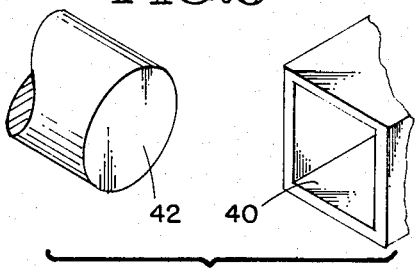
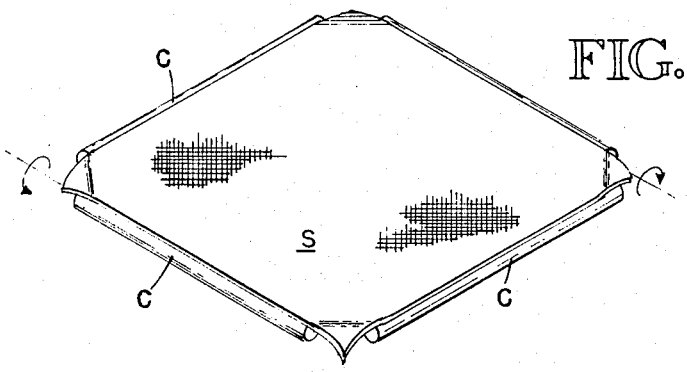
FIG. 5

STRETCHING FRAME WITH ADHESIVE FASTENING OF A FABRIC WORKPIECE

DESCRIPTION

1. Technical Field

This invention relates to a screen tensioning frame and the method of using it. In particular, the invention relates to a simple structural screen tensioning frame wherein the silk, canvas, or metal fabric is adhesively secured to the individual frame elements and then the appropriate tension applied by rotating the elements about their axis.

When the particular printing is completed, the screen may be removed and reused, or in the alternative retensioned and reused, the adhesive used has great shear strength but relatively little strength in a direction lateral thereto. The screen is simply peeled from the frame member when it is desired to replace it.

2. Background Art

The silk screen process, for single or multiple colored reproductions is well known and quite sophisticated. As is understood, the quality of the end product, i.e. the silk screened object is directly related to the quality of the screen material and to the tension of the fabric.

Devices for placing tension on fabric for use in silk-screening and/or other processes include those devices disclosed in the following U. S. Patents:

U.S. Pat. No. 484,137 granted to Cauffield on Oct. 11, 1892 which utilizes a plurality of clamps secured to flexible tensioning members such that the tension member can be rolled upon a roller until the appropriate tension is generated to stretch the fabric.

U.S. Pat. No. 988,331 granted to Greulich et al on Apr. 4, 1911 discloses a method of stretching leather wherein the leather is capable of being stretched in a plurality of directions because it utilized an irregularly shaped frame in conjunction with adjustable stretching devices.

U.S. Pat. No. 1,546,400 granted to Nichols July 21, 1925 discloses a stretch device for cloth wherein the frame member includes a plurality of outwardly extending teeth or pins to penetrate and grip the cloth for stretching.

U.S. Pat. No. 2,832,171 granted to Batey Apr. 29, 1958 discloses a rug frame wherein the fabric is gripped by a card cloth.

U.S. Pat. No. 3,211,089 granted to Messerschmitt, Oct. 12, 1965 discloses a screen printing screen wherein the screen is gripped along the edges by a frame member having telescopically secured elements and then the frame member is expanded outwardly through the utilization of an internal threaded member.

U.S. Pat. No. 3,226,861 granted to Bird on Jan. 4, 1966 discloses a stretching rack wherein the frame elements are cylindrical and have outwardly extending pins Tension on the fabric is generated by rotating the frame members and then holding them in position.

U.S. Pat. No. 3,273,497 granted to Rosema et al Sept. 20, 1966 discloses a screen stencil frame wherein the fabric is secured in position over a frame member and then the exterior portion of the frame member is moved outwardly to increase the tension on the screen.

U.S. Pat. No. 3,416,445 granted to Krueger on Dec. 17, 1968 discloses a screen stencil device wherein the screen is secured to border strips which are then subjected to outward pressure by another device increasing the tension on the screen.

U.S. Pat. No. 3,482,343 granted to Hamu on Dec. 9, 1969 discloses a frame for stretching sheet material wherein the sheet material is secured to an internal frame which is discontinuous and then the internal frame is moved outwardly toward the external frame creating the desired tension upon the material.

U.S. Pat. No. 3,601,912 granted to Dubbs on Aug. 31, 1971 discloses a screen stretching frame and the screen is clampingly secured to four cylindrical frame elements which are secured in a rectangular configuration by linking members at each corner and then the cylindrical members are rotated to provide the desired tension on the screen.

U.S. Pat. No. 3,774,326 granted to Selden on Nov. 29, 1973 includes an adjustable frame device for tensioning canvas or the like in one direction.

U.S. Pat. No. 3,908,293 granted to Newman on Sept. 30, 1975 discloses a screen tensioning and printing frame wherein the material is mechanically secured to four cylindrical frame members mounted to form a rectangle and which are then rotated to produce the desired tension upon the fabric.

DISCLOSURE OF THE INVENTION

It is an object of the present invention to provide a silk screen tensioning frame which is both simple of construction and simple to use.

It is another object of the present invention to provide a method for using a silk screen stretching device wherein the screen may be quickly and accurately attached to the frame and also quickly removed without destruction of the screen.

Yet another object of the present invention is to provide a screen tensioning frame wherein the screen may be retensioned after use.

Another object of the present invention is to provide a screen tensioning device wherein framework is uniform and does not include a receptacle which collects ink or other fluids.

A further object of the present invention is to provide a screen tensioning device wherein no fabric is wasted and further wherein unacceptable tension at the corners is avoided.

Still a further object of the present invention is to provide a method for preparing a screen for the silk screening process which includes the process of squaring the fabric by tearing along both the warp and the woof; laying the fabric on the frame; aligning the fabric with marks on the frame for the purpose of alignment; applying adhesive to one corner of the fabric securing it to the frame; stretching the fabric to an adjacent corner, applying adhesive to the second corner; repeating the above until the fabric is attached to each end of each side frame member; applying adhesive along the entire edge of the fabric; cure the adhesive and then stretch the fabric to the desired tension.

BRIEF DESCRIPTION OF THE DRAWINGS

FIG. 3 is a schematic of the methodology of the current inventive method.

FIG. 4 is an enlarged schematic view depicting the method of securing the fabric to the tension frame.

FIG. 5 is a schematic view depicting the actual tensioning process.

FIG. 6 is a partial corner view of an alternate embodiment of the present invention.

BEST MODE FOR CARRYING OUT THE INVENTION

Figure 1:
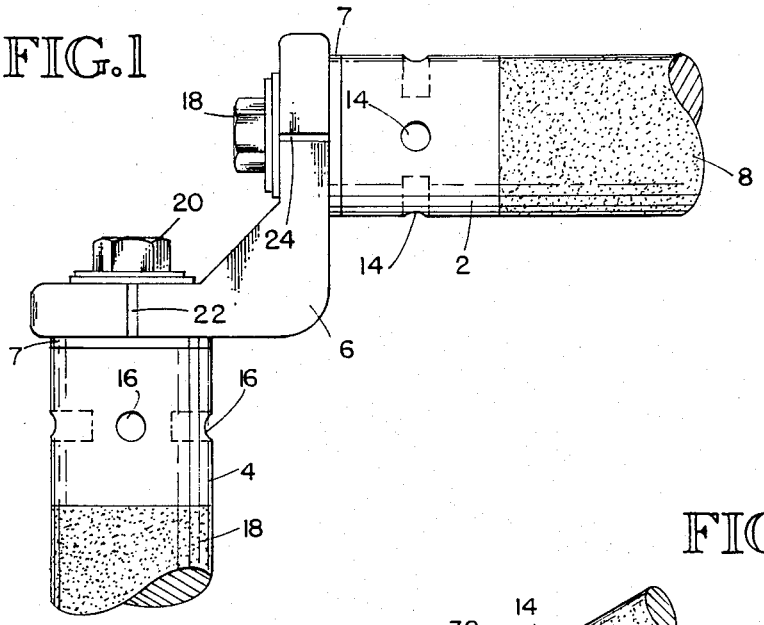
FIG. 1 is a plan view of one corner of the inventive tensioning frame.

FIG. 1 depicts one corner of four interconnected corners which make up the entire frame wherein the interlinking hollow cylindrical frame members 2, 4 are interconnected by a corner piece 6 having a bore therethrough. The hollow cylindrical members 2, 4 include a generally smooth surface with the exception of the sand blasted portion 8, 10 which is roughened for greater adhesion to the silk screen during the process of preparing for the silk screen process. A plurality of shallow bores 14, 16 are utilized with a tool T such as a spanner wrench for rotating the frame members 2, 4 for stretching the fabric.

A tightening bolt 18, 20 passes through corner piece 6 and through a compressible washer 7 and is threaded into the end of each of the frame members 2, 4 to secure the frame member in the appropriate tensioned position as explained hereinafter. The particular tension will depend upon the material and the printing to be accomplished. Because of slight intolerances in the machining of the parts, a compressionable washer is placed between the cylindrical tubes 2,4 and the corner 6 which compensates for the difference thus allowing the frame to lay flat.

It is to be noted also on this figure that the corner piece 6 includes, in addition to relatively perpendicular legs a scribe or mark 22, 24 to be used in aligning and securing the fabric.

Figure 2:
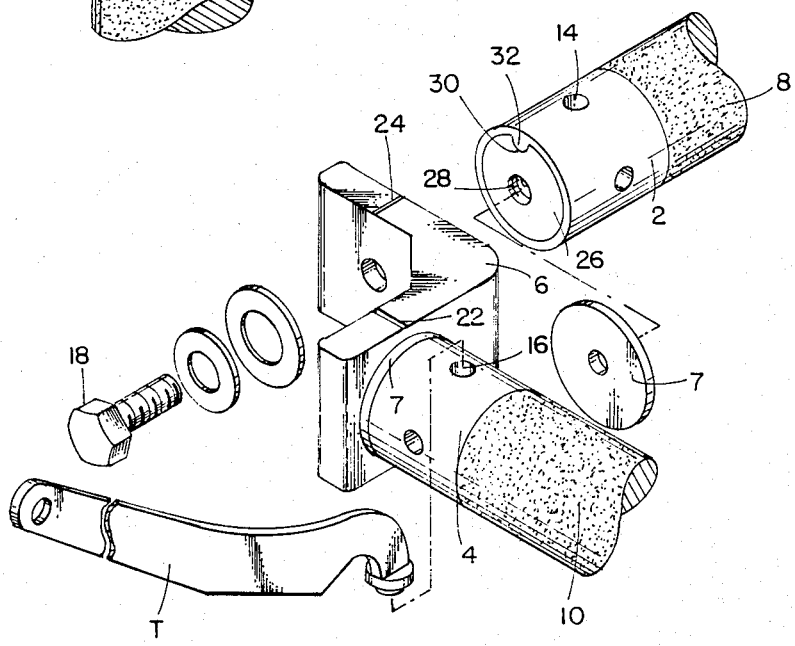
FIG. 2 is an exploded view of the corner section of FIG. 1.

Reference is now made to FIG. 2 wherein identical numbers are utilized for simplicity and it can be seen that a solid cylindrical insert 26 is placed in each end of hollow cylindrical frame member 2, said insert 26 being threaded as at 28 to receive bolt 18. It is to be noted that the insert 26 includes a groove 30 at its outer peripheral edge to mate with a ridge 32 on the interior of hollow cylindrical member 2. The ridge-groove combination prevents relative rotation between the cylinder and the plug and could be reversed. Alternatively, a locking pin could be used.

Referring now to FIGS. 3, 4, and 5 which schematically illustrating the method of securing a screen it can be seen in FIG. 3 that the screen fabric 5, which is torn to the approximate size along the warp and the woof, is placed upon the frame aligning a straight edge with both the marked line on the sand blasted area on the frame member cylinder (C) itself and the indicia 22, 24 on the corner member.

FIG. 6 depicts an alternate embodiment used for screens of small area. In this embodiment, one of the frame members 40 is rectangular and is fixed. The remaining three frame members 42 (only one shown) are tubular and operate as described hereinabove.

Once the screen S is placed appropriately on the cylinder C, a drop of the resin is placed onto the upper surface of the screen penetrating through the screen to the cylinder and is cured. The same process is applied to the other end of that particular cylinder C. The process is continued on all four corners of the frame (each end of the cylinder) and then a line of the adhesive is placed along the outermost edge of the fabric, it is cured and the device is ready for tensioning. The tensioning is accomplished by rotating each of the cylinders C outwardly until a proper tension is achieved. Due to the fact that the fabric will stretch during use, the desired tension may be regained by rotating the cylinders until the proper tension is once again achieved. This process provides the user with a means of maintaining the maximum quality of printing surface with the same fabric. A properly tensioned fabric is essential in eliminating the registration problems associated with multiple-color printing.

When said fabric is no longer needed on that particular frame, the tension is released from the screen and by means of an upward movement the fabric is severed from the roller. This same fabric can be placed on the same frame by simply removing the outside glued edge portion of the fabric by means of ripping the warf and the woof to again establish a straight edge. It is then glued in the same manner as previously stated. This process makes it possible to use the same fabric on the same frame a minimum of three times.

I claim:

1. A method of preparing a screen for silk screening comprising the steps of:
   1. preparing the screen by squaring the edges thereof;
   2. laying the screen on an appropriate sized frame having a plurality of frame elements and aligning each of the edges with an encoded portion of the frame;
   3. sequentially securing the corners of the screen to each end of each frame element while placing each edge under tension along the frame element, said securement being made with an adhesive;
   4. applying an epoxy resin along the entire edge portion of each of the edges;
   5. tensioning the screen by rotating the frame elements, outwardly.

2. A method of claim 1, wherein the screen edge is aligned with the encoded portion or a roughened portion of the frame member.

3. A method of claim 1, wherein the screen is kept under tension by tightening a bolt which passes through a linking element joining the ends of the frame elements.

4. A frame for use in a silk screen process, comprising:

four hollow cylindrical frame elements, each having a substantially unbroken exterior surface and including a plug at each end, said plug being mechanically locked to the frame element and including a threaded coaxial bore, a plurality of radial bores at the ends thereof to accept a spanner wrench or the like for placing tension on the screen and a defined roughened surface area to enhance the securement by chemical adhesion means of the screen fabric to the frame elements;

four corner blocks, said corner blocks being of L-shaped in cross-section, each leg of the L having a bore therethrough and a scored line on the upper surface thereof aide in the alignment of the screen, and a compressible washer at each end of the frame elements, a plurality of threaded elements passing through the bore of each corner block threadingly engaged with each end of each frame element whereby the threaded element may be loosened to adjust the tension of the screen and tightened to maintain the tension, whereby the screen fabric may be placed upon the frame, secured and tensioned without wasting fabric or overstressing the fabric corners.

* * * * *